United States Patent [19]

Nezu

[11] 4,227,800

[45] Oct. 14, 1980

[54] APPARATUS FOR LOADING CASSETTE CONTAINING RECORDING SHEETS

[75] Inventor: Takao Nezu, Hachioji, Japan

[73] Assignee: Konishiroku Photo Industry Co., Ltd., Tokyo, Japan

[21] Appl. No.: 974,101

[22] Filed: Dec. 28, 1978

[30] Foreign Application Priority Data

| | | | |
|---|---|---|---|
| Dec. 28, 1977 | [JP] | Japan | 52-157498 |
| Dec. 28, 1977 | [JP] | Japan | 52-157499 |
| Dec. 28, 1977 | [JP] | Japan | 52-157500 |
| Dec. 28, 1977 | [JP] | Japan | 52-157501 |

[51] Int. Cl.[3] ..... G03B 27/58; B65H 1/12; G03G 27/48

[52] U.S. Cl. ..... 355/72; 271/9; 355/3 SH

[58] Field of Search ..... 355/3 SH, 72, 3 R; 271/9, 10, 117, 127, 162

[56] References Cited

U.S. PATENT DOCUMENTS

| | | | |
|---|---|---|---|
| 3,827,687 | 8/1974 | Kono | 271/117 |
| 3,977,666 | 8/1976 | Suzuki et al. | 271/9 |
| 4,025,187 | 5/1977 | Taylor et al. | 355/3 R X |
| 4,087,178 | 5/1978 | Pfeifer et al. | 355/72 |
| 4,106,763 | 8/1978 | Tani et al. | 271/9 |

*Primary Examiner*—Donald A. Griffin

*Attorney, Agent, or Firm*—Bierman & Bierman

[57] ABSTRACT

Apparatus for loading a cassette containing a plurality of recording sheets into a device such that the sheets are fed to the device from a substantially constant, predetermined position.

4 Claims, 7 Drawing Figures

APPARATUS FOR LOADING CASSETTE CONTAINING RECORDING SHEETS

BACKGROUND OF THE INVENTION

1. Field of the Invention

The present invention relates to an apparatus for loading a cassette containing therein a plurality of recording sheets at a predetermined position in a sheet feeding portion of a business machine such as an electrophotographic copying apparatus, an offset printer to which the principle of the electrophotography is applied, or the like apparatus.

The present invention resides in an apparatus for loading a cassette containing therein a plurality of recording sheets, comprising an actuator lever having an end portion pivotally mounted on a frame of the apparatus, a micro-switch for detecting the sheet having an actuator disposed at an operative position within a space for receiving the cassette so as to be engageable with the sheet contained in the cassette, connecting mechanism for connecting the lever and the micro-switch to each other in such manner that the actuator of the micro-switch is displaced to an inoperative position exteriorly of the cassette receiving space from the operative position within the cassette receiving space when the other end of the lever is moved to the inoperative position, a cassette lock member capable of projecting into the cassette receiving space at an operative position, a connecting mechanism for connecting the lever and the lock member to each other in such manner that the lock member is displaced from the operative position within the cassette receiving space to an inoperative position exteriorly of the cassette receiving space when the other end of the lever is moved to the inoperative position thereof, sheet lifting means capable of projecting to an operative position within the cassette receiving space, and connecting means for connecting the sheet lifting means and the lever in such manner that the sheet lifting means is displaced from the operative position within the cassette receiving space to an inoperative position exteriorly of the cassette receiving space when the other end of the lever is moved to the inoperative position.

2. Description of the Prior Art

As is well known, a cassette containing a number of recording sheets is widely used in most copying apparatus. The use of a cassette which is adapted to be removably loaded in the copying apparatus brings about a great advantage in that replacement of the recording sheets of one size by those of other sizes can be easily carried out by merely exchanging the corresponding cassettes with each other. In order to have a better understanding of the invention, a brief view will be made on the recording sheet feeding system and the structure of the cassette which have been hitherto known. The sheet feeding system may be classified as follows:

(a) A sheet feeding roller is provided at the copying apparatus in such position that the feeding roller can be brought into engagement with the uppermost sheet of the stacked recording sheets, while the feeding roller is mounted to be vertically movable. The feeding roller is rotated in proper timing relation with the copying process thereby to feed out the recording paper sheet by sheet. Decrease in the number of the stacked sheets is followed by the progressive lowering of the feeding roller so that the last or lowermost sheet in the stack can be fed out.

(b) The feeding roller is mounted stationarily at a predetermined position of the copying apparatus. The feeding engagement between the roller and a stack of the recording sheets is attained by a lifting mechanism disposed below the stack of the recording sheets to exert a pressure to press the stacked sheets toward the feeding roller so that the last or lowermost recording sheet can be fed out to the copying apparatus.

As will be apparent from the description above, the starting position of the recording sheet to be fed out will be progressively varied in the case of the feeding system (a), while in the case of the feeding system (b) the recording sheet can be fed out always from the predetermined position. As will be described hereinafter in more detail, in the case of the conventional copying apparatus, the image position on the intermediate medium (which may be constituted by a rotatable drum having a photo-electrically conductive layer in the case of the electrophotographic copying machine or by a negative plate or an original negative in the case of the offset printer) has to be aligned with the recording sheet in a perdetermined relation. Accordingly, the feeding system (b) is adopted more widely than the feeding system (a), because the former is less susceptible to any undesirable deviations in positional relationship between the image position and the position of the recording sheet. Of course, in the case of the feeding system (a), there are known synchronizing means for attaining the positional alignment between the image to be transferred and the recording sheet.

Next, hitherto known structure of the cassette will be briefly described in junction with the cassette loading apparatus. An example of a cassette intended to be used in combination with the feeding system (a) described above is disclosed in Japanese Patent Publication No. 26847/1974 (refer to FIG. 2, in particular). According to the teachings of this prior application, a sheet supporting plate is loosely placed in the cassette for supporting a number of the recording sheets thereon while an aperture is formed in the bottom wall of the cassette. For loading the cassette into a copying apparatus, the sheet feeding roller is first held at a position not to be in contact with the uppermost recording sheet of the sheet stack contained in the cassette, and thereafter the cassette is fixedly positioned in the cassette receiving portion of the copying apparatus with the aid of a projection provided at the cassette receiving portion and adapted to engage in the aperture formed in the bottom wall of the cassette. In addition to the positioning function, the projection serves for supporting the sheet supporting plate inserted in the cassette so that the lowermost recording sheet of the sheet stack within the cassette lies constantly at a predetermined position.

A typical example of a hitherto known cassette to be used in combination with the feeding system (b) described above is disclosed in Japanese Laid-Open Patent Application No. 127632/1974 (refer to FIG. 2). According to the disclosure, the sheet supporting plate is loosely provided in the cassette bottom so as to be rotatable about an end thereof (the end positioned remote from the sheet feeding roller) while a spring is interposed between the sheet supporting plate and the bottom of the cassette at the position immediately below the sheet feeding roller. Another example of a hitherto known cassette is disclosed in Japanese Laid-Open Patent Application No. 131139/1974 (refer to FIG. 3, in particular). As in the case of the just above mentioned example, a sheet supporting plate is provided and the feeding engagement between the sheet stack and the feeding roller is accomplished by a pressing member which is adapted to bear on the lower surface of the sheet supporting plate through a corresponding aperture formed in the bottom of the cassette under the influence of a spring force.

A similar combination as that of the invention is disclosed in the above-cited Laid-Open Patent Application No. 131139/1974. However, in the case of this prior art, the step for fixedly locating the cassette in the cassette receiving portion of the copying apparatus is separated from the step applying the pressing action onto the stack of the recording sheets. More specifically, when the cassette is to be loaded, a lever associated with the pressing member is manually manipulated to retract the pressing member from the plane on which the cassette is slidably moved, and then the cassette is positioned at a predetermined position in the cassette receiving portion of the copying apparatus. Thereafter, by manipulating the lever in the reverse direction, the pressing member is caused to contact with the stack of the recording sheets. In other words, two different manipulations are required for loading the cassette to the ready position for effecting the copying process, which is of course troublesome.

SUMMARY OF THE INVENTION

An object of the present invention is intended to be applied to the sheet feeding system of the type (b) described above—i.e. the system for feeding the recording sheet constantly from a predetermined position—to provide a novel structure of the recording sheet containing cassette in which the lifting or upward movement of the sheet stack within the cassette to assure the feeding engagement with the feeding roller is accomplished by a pressing member provided at the side of the copying apparatus in combination with an improved structure of the cassette loading apparatus implemented in the copying machine.

The above and other objects, novel features and advantages of the invention will become more apparent from the following detailed description of a preferred embodiment thereof taken in conjuction with the accompanying drawings.

DETAILED DESCRIPTION OF THE PREFERRED EMBODIMENT

Figure 1:
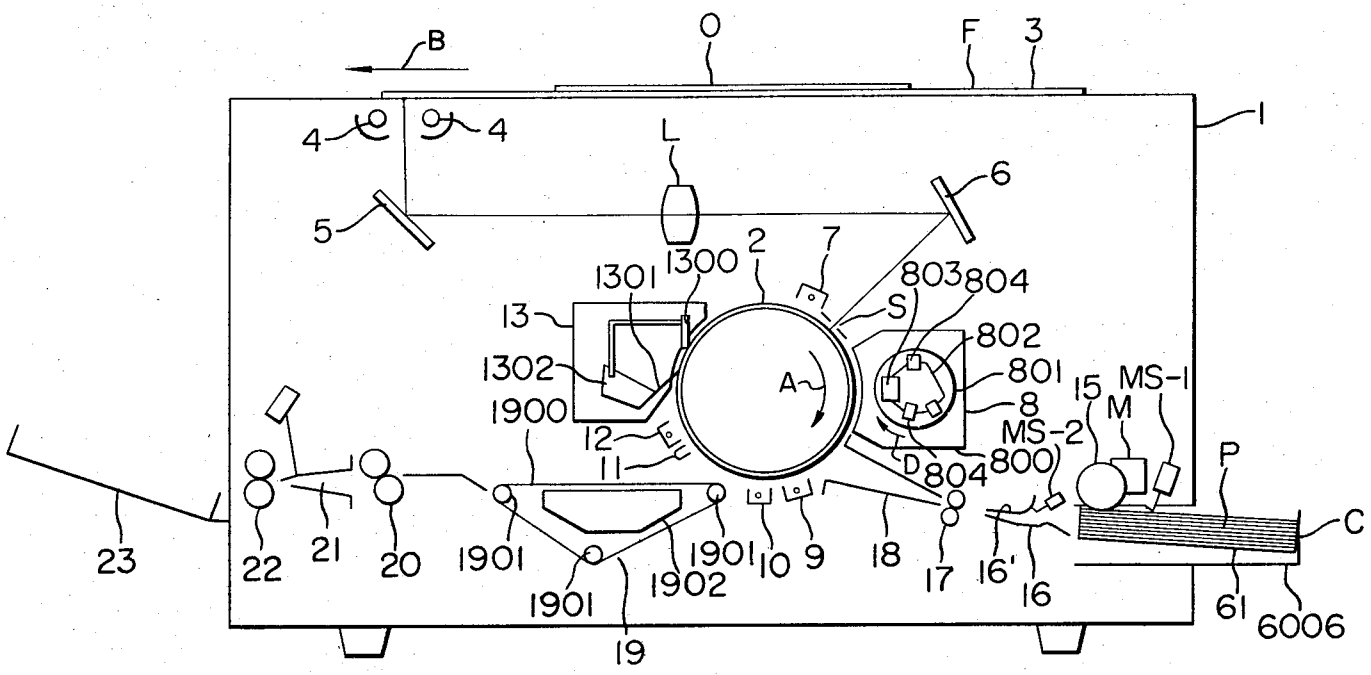
FIG. 1 shows schematically a general arrangement of an electrophotographic copying apparatus to which the invention can be applied.

In the first place, description will be made of a general arrangement of an electrophotographic copying apparatus of the transfer type to which the invention can be applied by referring to FIG. 1. The copying apparatus generally denoted by reference numeral 1 comprises a cylindrical drum 2 of a jointless structure having a circumferential surface coated with a photoconductive insulation layer of a material such as selenium, CdS or the like. The drum 2 is adapted to be rotated at a constant speed in the clockwise direction indicated by an arrow A when the copying operation is effected. Reference numeral 3 denotes a copy board made of a transparent glass plate and having an upper surface F on which the original to be copied is positioned. The copy broad 3 is adapted to be reciprocated in a manner well known in the art. More specifically, the copy board 3 is moved in the direction indicated by the arrow B at the same speed as the peripheral speed of the drum 2 for scanning the original lying on the surface F during the copying operation. The control system for carrying out the copying operation is well known in the art. Accordingly, further detailed description will be unnecessary.

There are disposed a pair of irradiation lamps 4, for example fluorescent lamps, below the path along which the copy board 3 is moved. The reflected light image as produced through irradiation from the lamps 4 is transmitted through a first mirror 5, a lens L and a second mirror 6 and impressed on the photo-conductive insulation layer of the drum 2 through a slit S. The photo-conductive layer of the drum 2 on which the light image of the original 0 is projected is previously imparted with a uniform electric charge through the action of the corona charging electrode 7.

Reference numeral 8 designates generally a magnetic brush developing apparatus which is adapted to produce a visible image or toner image on the circumferential surface of the drum 2 from the electrostatic latent image produced on that surface to conform with the pattern of the original 0 applied thereto through the slit S. The developing apparatus 8 is composed of a frame 800, an electrically conductive nonmagnetic cylindrical sleeve 801 made of aluminium, brass or the like material and a supporting member 802, and is adapted to be rotated in the direction indicated by the arrow D through a suitable drive means. The supporting member 802 is held securely by side plates (not shown) of the frame 800 and serves to support fixedly permanent magnets 803 and 804 which are disposed in the sleeve 801 with suitable spaces between them and relative to the inner wall of the sleeve, respectively.

The permanent magnet 803 which actually performs the developing action has a greater magnetic force and a larger dimension than those of the other permanent magnets 804 with a view to enlarging the contact width of the developing agent or developer to the drum 2 and simultaneously forming a soft layer of the developing agent or tuft of the developer which is preferable for a satisfactory development of the electrostatic latent image. The developing agent or developer is composed of a toner material and a carrier material and contained in a bottom portion of the frame 800. As will be appreciated, by rotating the sleeve 801 the developer is attracted onto the sleeve under the magnetic force of the permanent magnets, whereby a circulating flow of the developer is produced as the sleeve 801 is rotated.

In this connection, it is of course possible to control the thickness of developer deposited on the sleeve and to provide a means for applying a bias voltage to the sleeve 801.

There is disposed downstream of the developing apparatus 8 a transfer electrode 9 which is applied with a high voltage of the same polarity as that of the charging electrode 7 and serves to transfer the toner image developed on the drum 2 to a recording paper P when the latter passes by the electrode 9 as superposed on the toner image region.

Numeral 10 denotes a first discharging electrode for removing the electric charge from the image transfer paper P. To this end, the electrode 10 is connected to a suitable AC power source (not shown). Reference numerals 11 and 12 denote a charge removing lamp and a second discharging electrode for removing the potential remaining on the drum 2 and the toner particles thereon after the image transfer process described above. Disposed around the drum 2 downstream of the second charge removing electrode 12 as viewed in the rotating direction of the drum 2 is a cleaning apparatus 13 for taking off the remaining toner particles from the drum 2, which cleaning apparatus includes a blade 1300 made of an elastic material and adapted to be in contact with the circumferential surface of the drum 2, a toner collecting member 1301 made of a thin flexible sheet material such as polyester film and a toner containing box 1302, as main components. In operation, the toner particles remaining on the drum surface are scraped therefrom by means of the blade 1300 and introduced to the toner containing box 1302 through the toner collecting means 1301.

In the foregoing, the peripheral arrangement of the devices disposed around the drum 2 has been outlined. Next, description will be made of the transporting system for the recording paper sheet P. Symbol C denotes a cassette for accommodating therein a plurality of sheets of recording paper P and adapted to be disposed in the state shown in FIG. 1 when loaded in the copying apparatus. More specifically, a sheet supporting plate 61 which is loosely disposed in the cassette C (in reality, the plate 61 is pivotally supported on fulcrums formed in backside corner portions of a bottom plate 6006, as described hereinafter) is constantly subjected to an upward bias force under the pressing action of a press member mounted on the apparatus 1, whereby the uppermost sheet P of the paper stack is constantly brought into contact with a paper feed roller 15 which is mounted at a stationary position relative to the copying apparatus 1. The feed roller 15 is rotated by a drive motor M in proper timing relation to the process of the copying operation. A micro-switch MS-1 is provided for detecting presence of the recording paper P. In the case of the illustrated embodiment, the micro-switch MS-1 is adapted to cooperate with other micro-switches to indicate the size of the recording paper loaded in the copying apparatus, as described hereinafter.

Numeral 16 denotes a lower guide plate for guiding the paper sheet P as fed by the paper feeding roller 15. The guide plate 16 is formed with a bent portion 1600 (FIG. 5) for facilitating reception of the recording paper P in a looped configuration. Another micro-switch MS-2 is provided at a position to be able to contact with the loop of the recording paper P and produces a signal which functions to stop the energization of the drive motor M. In succession to the guide plates, there are provided a pair of transporting rollers 17 for receiving the recording sheet P from the lower guide plate 16. The transporting rollers 17 are so controlled that they remain inoperative in the initial stage of the copying operation; i.e. until the leading edge of the recording sheet P has attained the position to be nipped between the rollers 17. It should be mentioned here that the distance between the first transporting rollers 17 and the feeding roller 15 is selected to be shorter than the length of the recording sheet P as viewed in the transporting direction thereof.

The transporting rollers 17 which are inoperative in the initial phase of the copying operation are controlled to start the rotation in response to the synchronizing signal which is utilized for synchronizing the movements of the latent image region on the drum surface and the recording sheet P. Such synchronizing signal may be produced by a micro-switch (not shown) provided in the moving path of the copy board 3 when the passing-by of the board 3 is detected by the micro-switch. A guide means 18 is provided in succession to the first transporting roller 17. Reference numeral 19 denotes a recording sheet transporting mechanism for transporting the recording sheet or paper P after the toner image has been transferred to the sheet P from the drum 2.

The transporting mechanism 19 includes a conveyor belt 1900, a plurality of rollers 1901 on which the conveyor belt 1900 is suspended in tension and a suction or evacuating box 1902 connected to a vacuum suction means of a conventional construction for holding the sheet P stationarily on the conveyor belt.

Numeral 20 denotes a roller type fixation apparatus which may be of a given construction known heretofore.

Numeral 22 denotes discharge rollers for discharging the sheet P received through a guide means 21 outwardly from the copying apparatus, the discharged sheet being then received by a tray 23.

With the arrangement described above, the operation of the copying machine is effected in the manner described below. When a push button switch (not shown) for initiating the copying operation is actuated, the drum 2 and the copy board 3 start to move in the directions indicated by the arrows A and B, respectively. The photo-conductive layer on the drum 2 is electrically charged uniformly by the corona charging electrode 7 and subsequently supplied with the light image of the original O disposed on the copy board 3 and exposed to the irradiation from the lamps 4 through the projecting optical system composed of the first mirror 5, lens L and the second mirror 6 as well as the slit S.

Consequently, the electric charge stored in the photo-electrically conductive layer of the drum 2 is selectively removed in a pattern corresponding to the projected light image of the original O. In this manner, an electrostatic latent image of the original is produced and subsequently is converted into a toner image or visible image through contact with the developer layer including toner particles and carrier and often referred to also as the magnetic brush in the developing apparatus 8. Thereafter, the toner image region is moved toward the image transfer electrode 9 through the rotation of the drum 2.

The recording sheet or paper P is fed out from the cassette C under the feeding action of the feeding roller 15 driven by the motor M to the position where the leading edge of the recording sheet S has reached the first transporting rollers 17. When the drum 2 has been rotated to the predetermined position with the copy board 3 being simultaneously moved to a predetermined position, the first transporting rollers 17 are actuated in response to the signal from the micro-switch for detecting the copy board 3, whereby the recording sheet P is caused to pass by the transfer electrode 9 in the state superposed on the developed toner image on the surface of the drum 2. As a result, the toner image on the drum 2 is transferred to the recording sheet P under the action of the electric field produced between the electrode 9 and the drum 2.

The recording paper undergoing the image transfer process is then subjected to the corona discharge from the charge removing electrode 10 connected to an AC voltage source and leaves the drum 2.

The recording sheet P is successively transported by the transporting mechanism 19 to the fixation apparatus 20 comprising rollers whose surfaces are heated to a temperature required for fusing the toner material. Thus, the toner image is fixed on the recording sheet P under the combined actions of heat and pressure exerted by the fixation rollers 20. The recording sheet P having now the image of the original O copied thereon is discharged from the copying apparatus through the discharging mechanism 22 to the tray 23 disposed exteriorly of the copying apparatus.

On the other hand, the residual potential remaining on the drum surface and the toner particles is cleared by the neutralizing lamp 11 and the second charge removing electrode 12, while the residual toner particles are scraped from the drum surface by means of the blade 1300.

In the meantime, the copyboard 3 is returned to the starting position. The electrophotographic copying apparatus is now in a state of readiness to begin the next copying operation.

The cassette apparatus according to the present invention is intended to be utilized in combination with the copying apparatus of the construction described above. Description will now be made of an exemplary embodiment of the cassette apparatus according to the invention by referring to FIGS. 2 to 7.

Figure 2:
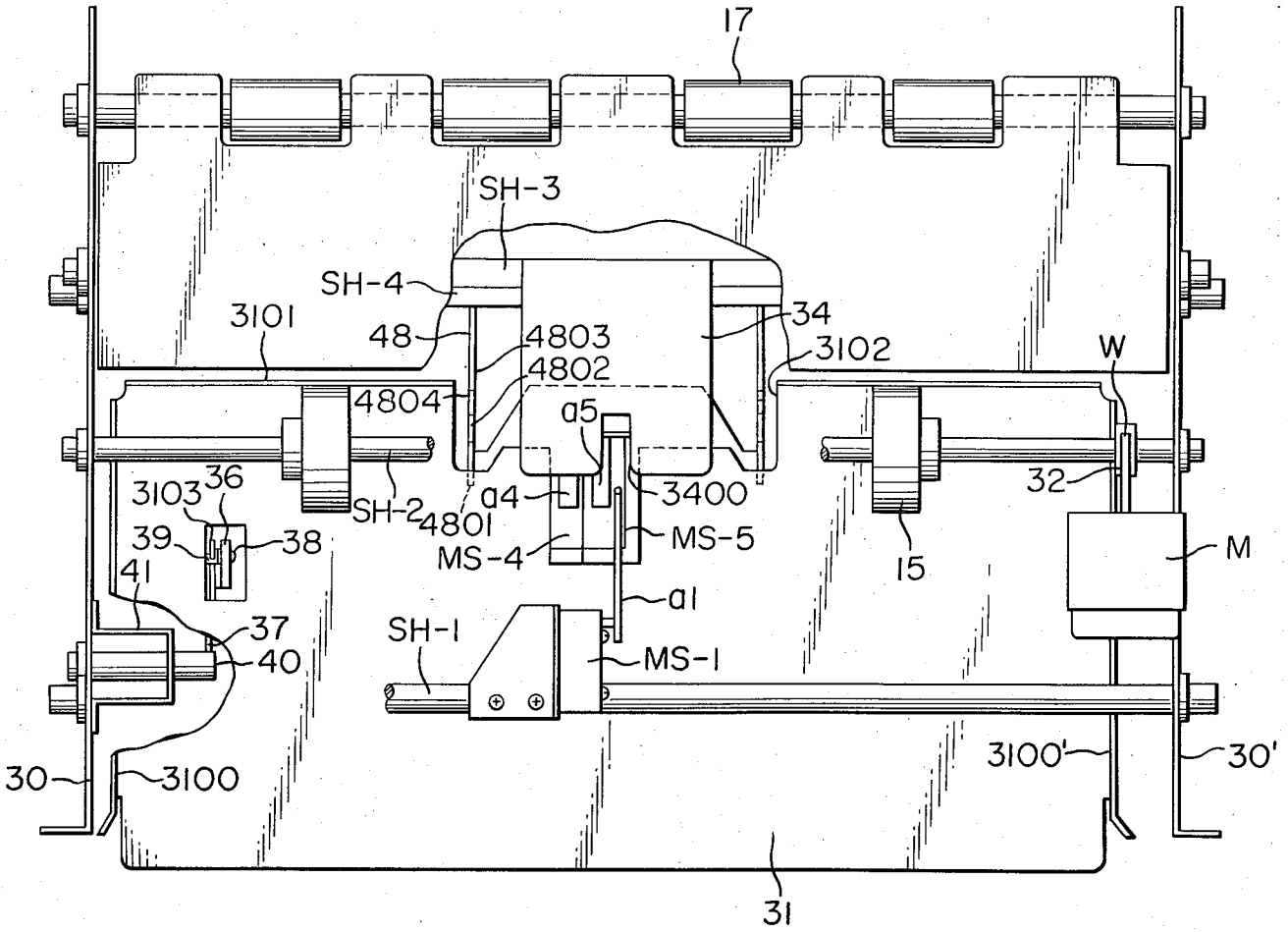
FIG. 2 is a fragmentary top plan view showing an embodiment of the cassette loading apparatus according to the invention.
Figure 5:
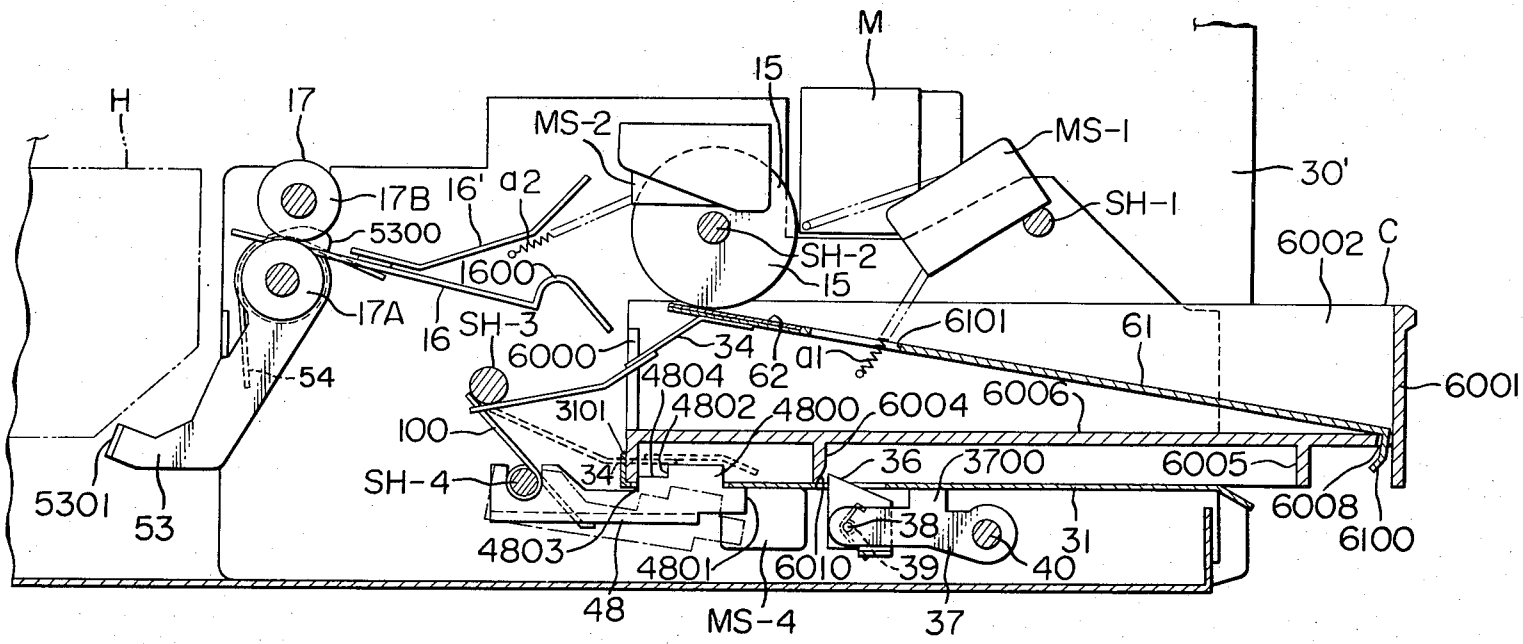
FIG. 5 is a vertical sectional view showing the various parts of the apparatus in the state in which the cassette has be loaded.

Reference is first made to FIG. 2 which is a schematic plan view showing a cassette receiving portion provided in the copying apparatus. In the figure, reference numerals 30 and 30' denote side plates of the copying apparatus, while numeral 31 denotes a supporting plate on which the cassette C is disposed as shown in FIG. 5. The plate 31 is formed with a notch 3102 at a middle portion of the front edge (left edge as viewed in FIG. 5) and has an upstanding wall 3101 formed along the front edge as well as upstanding walls 3100 and 3100' formed at its lateral sides (refer to FIG. 5). A micro-switch MS-1 for detecting the presence of the recording sheet P in the loaded cassette C is disposed over substantially the central portion of the supporting plate 31 and secured onto a shaft SH-1 which in turn is rotatably mounted on the lateral side plates 30 and 30'.

Mounted below the supporting plate 31 are micro-switches MS-4 and MS-5 which are so positioned that the respective actuators a4 and a5 project upwardly through the notch 3102 and at least one of them is operated when a cassette of a size corresponding to the recording sheet to be used is loaded into the copying apparatus. So far as the actuator a1 of the micro-switch MS-1 is energized, five kinds of size of the recording sheet used can be displayed through the combinations of the output states of the micro-switches MS-1, MS-4, and MS-5 as listed in the following table in which "1" represents one state of the output of these switches, while "0" represents the opposite state.

TABLE

| Size of Recording Sheet | Micro-Switch | | |
|---|---|---|---|
| | MS-1 | MS-4 | MS-5 |
| A3 | 1 | 0 | 0 |
| A4, B5 | 1 | 1 | 0 |
| B4 | 1 | 1 | 1 |
| B6 | 1 | 0 | 0 |

In this manner, the size of the recording sheet being loaded into the copying apparatus can be displayed, thereby preventing erroneous operation.

The sheet feeding roller 15 described hereinbefore in conjunction with FIG. 1 is rotatably supported by the side plates on a mounting shaft SH-2 which has a worm wheel 32 at the right end portion thereof as viewed in FIG. 2. The worm wheel 32 is adapted to mesh with a worm W provided on the output shaft of the drive motor M operated in synchronism with the copying operation of the copying apparatus. The pressing plate 34 described hereinbefore which may be made of bronze phosphate is disposed above a middle portion of the front edge of the supporting plate 31 and interlocked to a cam lever 35 through a shaft SH-3. A notch 3400 is formed in the free end of the pressing plate 34 so that the free end or edge portion of the plate 34 is bifurcated.

Figure 4:
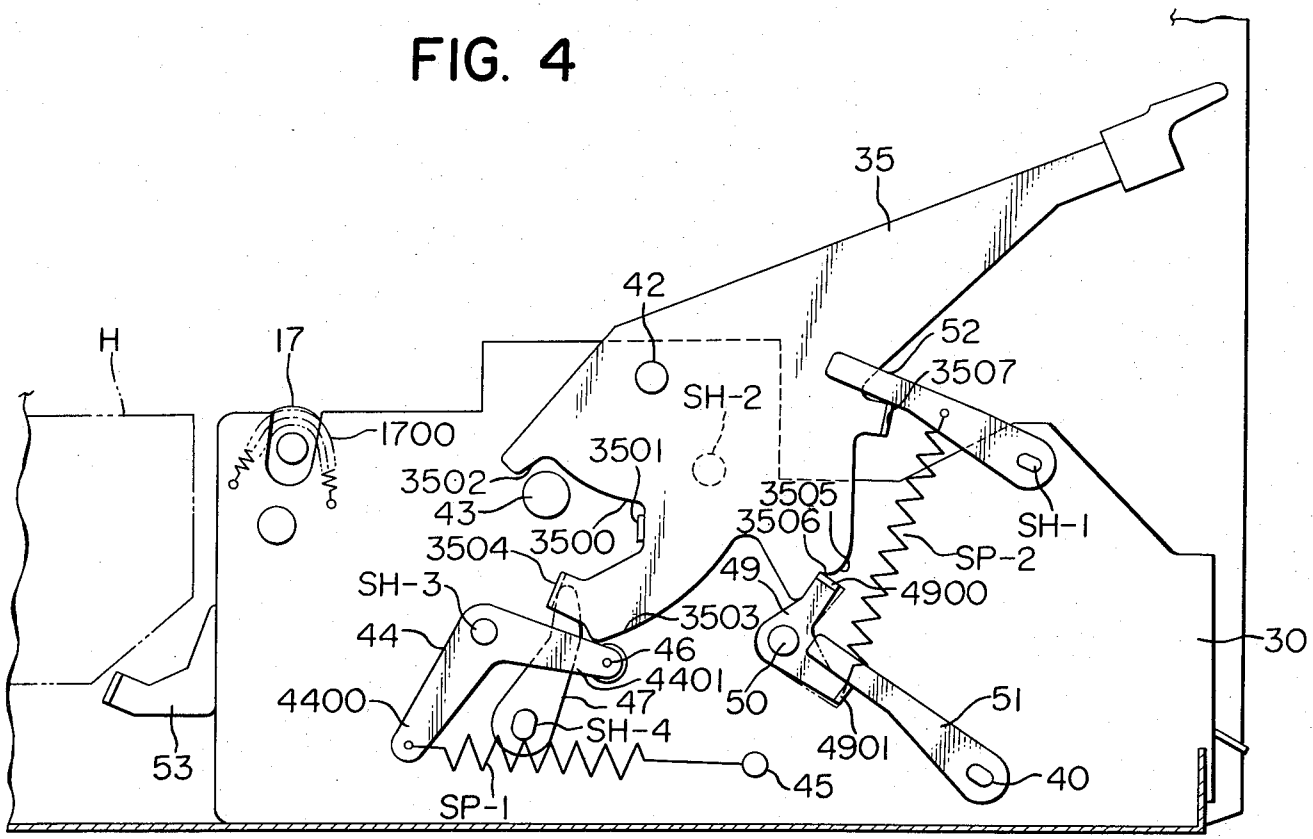
FIG. 4 is a view similar to FIG. 3 but showing the apparatus in an inoperative state.

The arrangement is such, that when the cam lever 35 is lifted up as shown in FIG. 4, the pressing plate 34 is maintained at a first position substantially parallel with the supporting plate 31 as indicated by broken line in FIG. 5.

When the cassette C is slidably inserted onto the supporting plate 31 in this state, the pressing plate 34 can be inserted into the cavity or space defined between the sheet receiving plate 61 and a flat bottom portion 6007 of the cassette C exposed at the front end portion thereof.

Additionally, when a leg member 6004 formed in the bottom of the cassette C presses down a sensor projection 36 projecting through an opening 3103 formed in the base plate 31 during the movement of the cassette C to the loaded position, the pressing plate 34 is maintained at a second position inclined upwardly through the shaft SH-3, as indicated by solid line in FIG. 5. In this second position of the pressing plate 34, the sheet supporting plate 61 in the cassette C is urged upwardly, whereby the uppermost recording sheet of the paper stack contained in the cassette C is brought into contact with the aforementioned feeding roller 15 under pressure.

The sensor projection 36 described above is mounted in the manner mentioned below. Referring to FIGS. 2 and 5, a pin 40 is mounted rotatably on the side plate 30 by means of a bearing member 41 of a channel-like cross section. Secured to the rotatable pin 40 is an arm 37 which has a stud 38 extending perpendicularly from the arm 37.

The sensor projection 36 is biased to be rotated in the clockwise direction as viewed in FIG. 5 by spring 39 and bears on the arm 37. When the sensor projection 36 is pressed down by the leg member 6004 of the cassette C during the movement thereof to the loaded position, the arm 37 is rotated thereby to rotate the pin 40, whereby the cam lever 35 is released from the locked upper position, as will be described in more detail hereinafter. It should be however noted that, in the course of the movement of the cassette C in the opposite direction for the withdrawal thereof, the leg member 6004 brings about only the rotation of the sensor element 36 against the force of the spring 39 with the arm 37 and the pin 40 remaining inoperative. After the passage of the leg member 6004, the sensor projection 36 is restored to the illustrated position.

Figure 3:
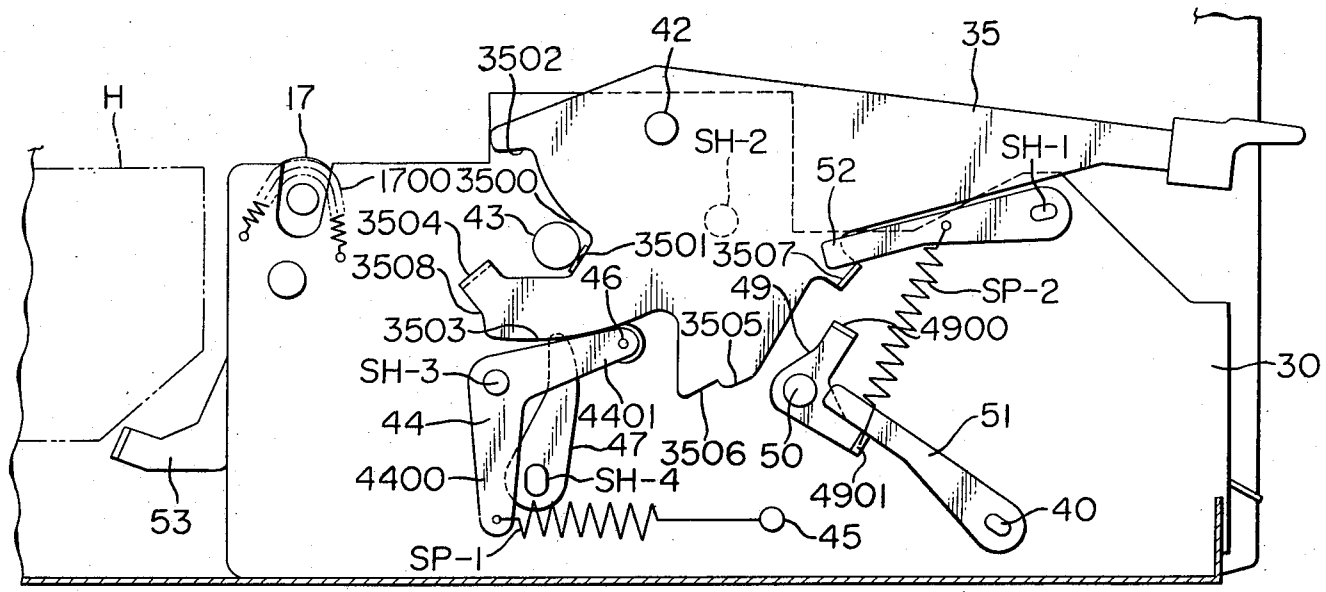
FIG. 3 is a side view of the same shown in the operated state.

In the following, interlocking mechanisms will be described by referring to FIGS. 3 to 5. In FIGS. 3 and 4, the cassette C is omitted from illustration for the sake of simplification.

The cam lever 35 described above is pivotally mounted on a pin 42 anchored to the lateral side plate 30 so as to be rotatable about the pin 42 in the vertical direction.

A stopper pin 43 is secured to the lateral side plate 30 and positioned in a concaved portion 3500 of the cam lever with a view to delimiting the allowable maximum rotation angle of the cam lever 35. More specifically, the cam lever 35 is constantly urged to be rotated in the clockwise direction under the biasing force of the spring SP-1 by way of an angle lever 44 having a lower arm 4400 to which the spring SP-1 is secured at one end thereof with the other end being secured to a pin 45 anchored to the side plate 30. Thus, the clockwise rotation of the cam lever 35 is limited by the stopper pin 43 adapted to engage against the lower limit end 3501 of the concaved portion 3500 of the cam lever 35. The pin 43 further serves to limit the counterclockwise rotation of the cam lever 35 in cooperation with the upper limit end edge 3502 of the concaved portion 3500.

The cam lever 35 has a cam surface 3503 which is adapted to be engaged by a cam follower roll 46 rotatably supported by the upper arm of the angle or forked lever 44 which is urged to rotate in the counterclockwise direction by the spring SP-1, as described hereinbefore, whereby the cam lever 35 is constantly subjected to the force to rotate it in the clockwise direction. It should be mentioned that the angle lever 44 is fixedly secured to the rotatable shaft SH-3 to which the pressing plate 34 is also secured.

Thus, by lifting up the cam lever 35 in the counterclockwise direction from the position shown in FIG. 3, the angle lever 44 is rotated in the clockwise direction against the force of the spring SP-1, as the result of which the shaft SH-3 is rotated to lower the pressing plate 34 to the first position defined hereinbefore. On the other hand, when the cam lever 35 angle lever 44 is caused to rotate in the counterclockwise direction under the influence of the spring SP-1, the corresponding rotation of the shaft SH-3 thereby moves the pressing plate upwardly to the second position defined hereinbefore.

A lever 47 shown in partially superposed relation to the angle lever 44 in FIG. 3 is located between the side plates 30 and the cam lever 35 and is secured fixedly to a shaft SH-4 supported rotatably between the side plate 30 and 30'. The lever 47 is usually positioned out of contact with the cam lever 35. However, when the cam lever 35 is rotated in the counterclockwise direction, the free end of the lever 47 will engage with bent portion 3504 formed in the cam lever 35 between the concaved portion 3500 and the cam surface 3503, whereby the lever 47 is caused to be rotated in the clockwise direction until the upper limit end 3502 of the concaved portion 3500 formed in the cam lever 35 impinges on the stopper pin 43.

The shaft SH-4 is positioned below the shaft SH-3 to which the afore-mentioned pressing plate 34 is secured and is provided with a locking member 48 which is adapted to project upwardly through the notch 3102 and beyond the base plate 31 for a predetermined distance, as shown in FIG. 5, when the cam lever 35 is in the lowered position shown in FIG. 3. From mid course of the upward movement of the cam lever 35, the locking member 48 is progressively retracted below the base plate 31 due to the clockwise direction of the lever 47. In other words, the rotation of lever 47 as caused by the rotation of the cam lever 35 will be sufficient, so long as the locking member 48 is retracted to a level lower than the upper plane of the base plate 31 during the rotation of the cam lever 35 in the counterclockwise direction.

Accordingly, it will be appreciated that the arrangement may be made such that the retracting movement of the locking member 48 is initiated during the initial phase of the rotation of the cam lever 35 in dependence on the selected geometrical relationship between the locking member 48 and the base plate 31. As is shown in FIG. 5, a leaf spring 100 having one end secured to the shaft SH-3 is supported on the shaft SH-4 serving as a fulcrum and has its other end portion engaged with the lower side of the locking member 48 thereby to urge the latter in the counterclockwise direction.

However, such movement of the locking member 48 in the counterclockwise direction is restricted by an offset portion 4801 formed at the free end of the member 48 and adapted to engage the lower surface of the base plate 31. In the case of the embodiment illustrated in FIG. 5, the first and second offset portions 4802 and 4803 are formed at the front side (left side as viewed in the figure) of the highest projection 4800 in addition to the rear offset portion 4801. The purpose of providing such offset lock portions will be described fully in conjunction with the loading operation of the cassette C.

Reference numeral 49 denotes a latch lever which is rotatably mounted on a pin 50 anchored to the side plate 30 and serves for locking the cam lever 35. The latch lever 49 is implemented as a forked or bifurcated lever and has bent end portions 4900 and 4901 formed at the free ends of the lever arms, respectively. Engaged with the lower bent end portion 4901 is the free end portion of a first actuator lever 51. The actuator lever 51 is secured at its opposite end to the rotatable shaft or pin 40 adapted to be rotated through the movement of the sensor projection 36 described hereinbefore. On the other hand, a second actuator lever 52 is fixedly connected to the rotatable shaft SH-1 on which the microswitch MS-1 is mounted and has a free end portion resting on a bent projection 3507 formed at the rear side of the cam lever 35.

It will be seen that a tension spring SP-2 is suspended between the lower bent end portion 4901 of the latch lever 49 and the second actuator lever 52. As will be readily understood, the spring SP-2 serves to restrict the clockwise rotation of the latch lever 49, when the cam lever 35 has been lowered to the lowermost limit position defined by the stopper pin 43, as is shown in FIG. 3. The latch lever 49 which is thus positioned at a predetermined position by means of the tension spring SP-2 functions to maintain the first actuator lever 51 at such position in which the sensor projection 36 projects beyond the plane of the base plate 31, in cooperation with the rotatable pin 40 and the arm 37.

In the state described above, the upper bent portion 4900 of the latch lever 49 is disengaged from the cam lever 35. With the arrangement described above, when the cam lever 35 is rotated in the counterclockwise direction, the second actuator lever 52 is lifted upwardly by the bent portion 3507 of the cam lever 35 against the biasing force of the spring SP-2, while the first actuator lever 51 and the latch lever 49 remain in the same position, because the projection 3700 formed in the arm 37, which is secured to the pin 40 together with the first actuator lever and the latch lever 49, bears against the lower surface of the base plate 31. When the cam surface 3505 formed in the rear side of the cam lever 35 comes into contact with the upper bent portion 4900 of the latch lever 49, the latter is moved to a slight degree in the clockwise direction. When a latch 3506 formed in the cam lever 35 overpasses the bent portion 4900 of the latch lever which is extended substantially perpendicularly to the cam surface 3505, the latch lever 49 is restored to the home or first position under the influence of the spring SP-2. Inasmuch as the spring SP-2 exerts sufficient force to pull downwardly the free end portion of the second actuator lever 52, a portion of the bent portion 4900 will remain in the state engaged with the latch surface 3506 by stopping the rotation of the cam lever 35 just at the time when the latch surface 3506 is positioned on the bent end portion 4900 of the latch lever 49.

Since the shaft SH-1 is imparted with rotation in the clockwise direction through the second actuator lever 52, the micro-switch MS-1 for detecting the presence of the recording sheet will undergo a corresponding rotation, as the result of which the actuator a1 thereof is moved upwardly to the position indicated by broken line in FIG. 5. By the way, the actuator a1 of the micro-switch MS-1 as well as the actuator a2 of the micro-switch MS-2 for detecting the presence of the recording sheet in a looped form in front of the transporting rollers 17 as described hereinbefore are each constituted by a coil spring formed of a fine metallic wire. However, these actuators a1 and a2 may be formed of solid members, respectively.

Referring to FIG. 5, the guide structure 16 has a lower guide plate formed with a bent free end portion 1600 at the inlet side so as to facilitate formation of the loop of the recording sheet, as described hereinbefore in conjunction with FIG. 1. The actuator a2 of the micro-switch MS-2 for detecting the presence of the loop extends over bent portion 1600. The upper guide plate 16' serves to aid the detection of the looped recording sheet P by the micro-switch MS-2. Namely, in order to allow the diameter of the loop to be freely increased thereby to move the actuator a1 upwardly, the upper guide plate 16' is formed with a notch at a corresponding position. The lower roller of the first transporting roller assembly 17 is operatively coupled to a suitable drive system and controlled in the manner described hereinbefore in conjunction with FIG. 1.

A lever 53 is secured to the shaft of the lower roller 17A of the first transporting roller assembly 17 at the inner side of the side plate 30 and has a cam portion 5300 engageable with the shaft of the upper roller 17B. This arrangement including the cam lever 53 is intended to eliminate clogging or jamming of the recording sheet P at the first transporting roller assembly 17.

More particularly referring to FIG. 5, when a holder member H indicated by double dotted line for supporting together the transfer electrode and the charge removing electrode is rotated in the clockwise direction about a pivot pin not shown in the drawing but positioned at the left side of the holder H, a right lower end portion of the holder member H is brought into contact with the projecting lower end 5301 of the lever 53, whereby the lever 53 is rotated in the counterclockwise direction. Consequently, the upper roller 17B is caused to move upwardly by the cam portion 5300 to produce a gap relative to the lower roller 17A. Thus, the recording sheet P clogged between the upper and the lower rollers 17B and 17A can be easily removed. It is preferred that the lever 53 should be provided at both sides of the rollers 17.

The lever 53 is urged resiliently in the counterclockwise direction by means of a spring 54. The rotation of the lever 53 is restricted by a stopper projection 530 formed at the inner side of each of the side plates 30 and 30'.

Figure 6:
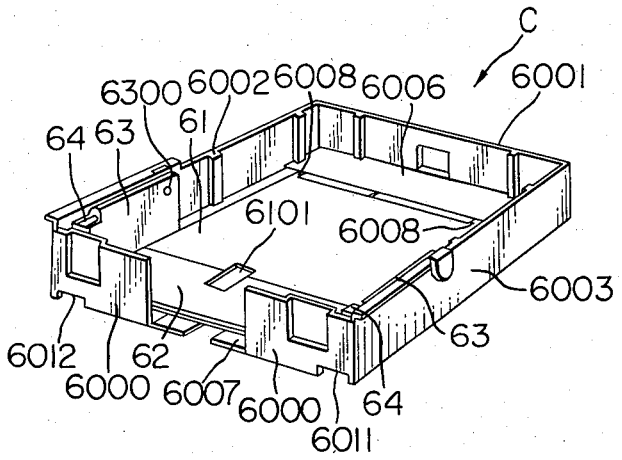
FIG. 6 is a perspective view of a cassette according to an embodiment of the invention as viewed from the top.
Figure 7:
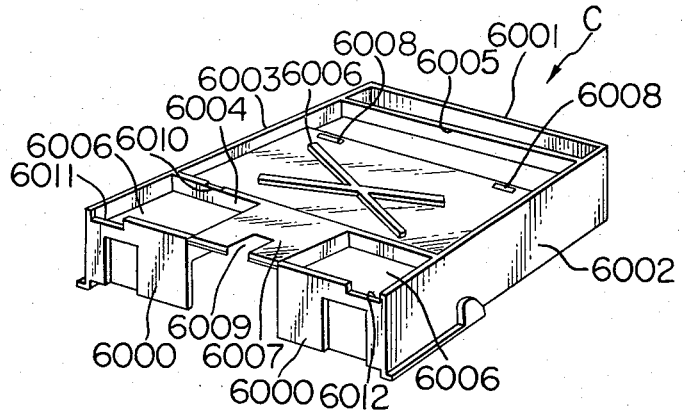
FIG. 7 is a perspective view of the same as viewed from the bottom thereof.

Next, an exemplary embodiment of the cassette C according to the invention will be described by referring to FIGS. 5, 6 and 7. The cassette C may be formed of a resin by molding and has a front wall 6000, a rear wall 6001, a left side wall 6002, a right side wall 6003 and a bottom wall 6006. A notch is formed in the front wall 6000 at the middle portion thereof.

The portions of cassette C which are brought into direct contact with the upper or top surface of the base plate 31 are flat lower surfaces of the walls 6000, 6001, and 6003, legs 6004 and 6005 and the concaved portion 6007 described hereinafter. The bottom wall is formed with a coplanar upper flat surface which is able to contact with a portion of the lowermost recording sheet of the paper stack or the sheet supporting plate 61.

As can be seen from FIG. 5, the leg 6004 of the cassette C is formed with a bevelled or inclined lower edge 6010 facing to the right as viewed in the figure at a position for contact with the sensor projection 36 described hereinbefore when the cassette C is slidably inserted onto the base plate 31. Further, it will be noted that notches 6011 and 6012 are formed in the lower edge of the front wall 6000 at both sides thereof. The notch 6011 is formed at the location corresponding to the position of the bevelled edge 6010 of the leg 6004 so that the sensor projection 36 may be relatively passed without contact with the lower edge of the front wall. On the other hand, the afore-mentioned concave portion 6007 is interposed between the leg 6004 formed in the bottom wall 6006 and the front wall 6000 in alignment with the central notch formed in the latter. Formed in the bottom wall 6006 at a rear end portion thereof adjacent to the side walls 6002 and 6003, respectively, are slit-like apertures 6008 extending in the transverse direction, while a notch 6009 is formed in the bottom of the concave portion 6007 and opened to the front wall side.

The slit-like apertures 6008 serve to receive therein projections 6100 formed at the rear edge of the sheet supporting plate 61 and projecting downwardly, when the latter is inserted into the cassette C for supporting the stack of the recording sheets P thereon. Of course, it is also possible to provide the slit-like apertures 6008 at different positions in consideration of the size of the sheet supporting plate 61, e.g. at a middle portion of the bottom wall 6006. Besides, latch means of any suitable conventional type may be employed to the same effect.

The notch 6009 is provided with a view to evading energization of the microswitch MS-4 or MS-5 by the bottom wall 6007. These switches serve to detect the size of the recording sheet to be used for which purpose all of the actuators are projected through the opening provided in the supporting plate 31 as described hereinbefore. The position of the notch 6009 is varied in dependence on the size of the recording sheet contained in the cassette C. In the case in which both of the switches MS-4 and MS-5 are to be energized, the provision of the notch 6009 is unnecessary. In this manner, by selecting relationships between the number, width or the positions of the notch 6009 and the micro-switches MS in various combinations, it is possible to detect the recording papers of the various sizes and to indicate the detected sizes by a display means provided in the control panel. For example, depression of either one of the micro-switches MS-4 and MS-5 by the lower surface of the concaved bottom 6007 may be utilized to produce an electrical signal to indicate the corresponding size of the recording sheet at the associated display means on the control panel.

The sheet supporting plate 61 is provided with a frictional layer 62 at a front end portion underlying the sheet transporting roller 15 for suppressing the possibility that two sheets should be simultaneously fed from the paper stack when the number of the recording sheets stacked on the plate 61 is decreased as the copying process proceeds. A longitudinal slot 6101 is formed in the sheet supporting plate 61 and extends partially in the region of the frictional layer 62. When the recording sheet on the plate 61 have been exhausted, the actuator a1 of the micro-switch MS-1 can drop in the slot 6101 thereby to actuate the switch for signaling the absence of the recording sheet.

The concave portion 6007 which is closed at the top thereof by the lower surface of the sheet supporting plate 61 defines the cavity to receive therein the pressing plate 34 described hereinbefore upon loading of the cassette in the copying apparatus. The pressing plate 34 is maintained at the first lower position when the cassette is loaded in the copying apparatus for insertion into the cavity defined by the concave portion 6007. An inner side plate 63 is disposed at each side of the cassette C with a space to the side wall 6002 or 6003.

Reference manual 64 denotes a pair of separating claws of a known structure adapted to engage the front edge corners of the uppermost recording sheet. The claws 69 serve to prevent double sheet feeding. Each of the separating or delaminating claws 64 is pivotally mounted on the inner side plate 63 at the front end portion.

With the arrangement of the cassette receiving portion of the copying apparatus and the construction of the cassette described above, the loading of the cassette into the copying apparatus is effected in the manner described below.

The recording sheets P are initially contained in the cassette C of the size corresponding to the recording sheet to be used, and the claws 64 are set to the engaging position. On the other hand, the cam lever 35 of the loading apparatus is rotated in the counterclockwise direction from the position shown in FIG. 3 to the position shown in FIG. 4. Because of the camming action exerted by the cam surface 3503 of the cam lever 35 onto the upper arm 4401 of the forked lever 44, the latter is forcibly caused to rotate in the clockwise direction.

Since the forked lever 44 is secured to the rotable shaft SH-3, the pressing plate 34 which is also fixedly secured to the same shaft SH-3 is caused to be moved from the second or upper position shown in FIG. 5 to the first or lower position in which the pressing plate 34 can be inserted into the cavity defined by the concave portion 6007 at the front end of the cassette C. During the rotation of the cam lever 37, the bent portion 3504 of the cam lever 35 impinges on the lever 47 to rotate it in the clockwise direction. The rotating movement of the lever 47 is transmitted to the locking member 48 through the rotatable shaft SH-4 to which both the lever 47 and the locking member 48 are secured. Consequently, the locking member 48 is lowered from the projecting position beyond the base plate 31 shown by the solid line in FIG. 5 to the retracted position indicated by the broken line in the same figure. In the meantime, the second actuator lever 52 secured to the rotatable shaft SH-1 is caused to rotate in the clockwise direction against the biasing force of the spring SP-2 by virtue of the engagement with the bent portion 3507 of the cam lever 35, as a result of which the micro-switch MS-1 connected fixedly to the shaft SH-1 for detecting of the record sheet is moved from the position indicate by the solid line in FIG. 5 to the upper position suggested by the broken line. In the mid course of the rotation of the cam lever 35, the latch lever 49 is also operated. More particularly, the lever 49 is caused to rotate in the clockwise direction to the position shown in phantom line in FIG. 4 due to the engagement between the cam surface 3505 of the cam lever 35 and the bent portion 4900 of the lever 49.

Accordingly, the first actuator lever 51 resting on the lower bent portion of the latch lever 49 is rotated in the counterclockwise direction for the same distance as the lever 49. The time duration in which the upper bent portion 4900 of the lever 49 is in the state engaging with the cam surface 3505 of the cam lever 35 as well as the magnitude of rotation of the lever 49 are very small. The bent portion 4900 will be soon displaced to the engaging position with the latch surface 3505. At this time, the cam lever 35 can be held in the position shown in FIG. 4 by removing the acting force from the lever 35. When the cam lever 35 has been rotated to the position in which the stopper pin 43 impinges on the upper limit edge 3502 of the cam lever 35, the follower roller 46 is in engagement with the concave contour portion 3508. In this series of operations, the rotation angle of the pin 40 and hence those of the first actuator lever 51 and the arm 37 holding the sensor projection 36 is very small, whereby the sensor projection 36 is maintained constantly in the position projecting beyond the upper plane of the base plate 31. After completion of the above described operations, the pressing plate 34, the locking member 48 and the micro-switch MS-1 (actuator al) are set to the positions to receive the cassette C.

Now the cassette can be inserted over and along the base plate 31. The cassette is moved smoothly inward (toward the top as viewed in FIG. 2 and to the left as viewed in FIGS. 3 and 4) without being disturbed by the sensor projection 36 due to the provision of the notch 6011 formed in the front wall 6000 of the cassette C. When the leg 6004 formed in the bottom of the cassette has attained the position of the projection 36, the latter is moved downwardly by the lower adge of the leg 6004 engaging the bevelled upper edge of the sensor projection 36. Through the displacement of the sensor projection 36, the first actuator lever 51 is rotated in the counterclockwise direction by way of the arm 37, as a result of which the upper bent portion 4900 of the latch lever 49 is ultimately disengaged from the latch edge 3506 of the cam lever 35. Then, the cam lever 35 is rapidly restored to the starting position shown in FIG. 3 through a clockwise rotation under the biasing forces of the springs SP-1 and SP-2.

Simultaneously, the front end portion of the sheet supporting plate 61 is caused to move upwardly by the pressing plate 34 thereby to bring the uppermost recording sheet P of the paper stack in contact with the feeding roller 15. The cassette as well as the cassette receiving portion of the copying apparatus may be so designed that the loading of the cassette C is completed at this point in time. However, in the case of the illustrated embodiment of the invention it is so designed that the lower edge of the leg 6004 still remains on the bevelled upper edge of the sensor projection 36 with the lower edge of the front wall 6000 being at the position just having passed by the first offset portion 4802, regardless of the actuation of the sensor projection 36 bringing about the series of operations of the various elements described above.

In other words, the loading of the cassette C is not completed at the instant point in time. According to the invention, it is intended that the loading operation of the cassette be completed by means of the locking member 48. In this connection, it should be mentioned that a locking member having a single latch offset or step will involve necessarily backlash in the locked state for various reasons such as non-uniformity or manufacturing tolerance of the component parts, precision at the assembling, the inserted state of the cassette (e.g. positional misalignment of the cassette and the base plate due to dimensional difference therebetween) or the like. Such backlash or looseness is of course undesirable from the viewpoint of attaining a positively locked state. This problem can be solved by providing the locking member 48 with two offset portions or steps according to a feature of the invention.

Describing in more detail, in the state in which the cam lever 35 is lowered to the original position with the locking projection 4800 of the locking member 48 projecting partially beyond the upper surface of the base plate 31, the cassette C can not be withdrawn unless the lever 35 is again rotated upwardly, because the rear surface of the lower edge portion of the front wall 6000 of the cassette C will be then engaged by the first latch step or offset portion 4802. By the way, the projecting portion of the locking member 48 is not allowed to project completely due to the fact that the lower edge of the front wall 6000 of the cassette C rests on the horizontal surface 4804 contiguous to the first offset portion 4802. When the cassette is further moved inwardly, the front wall 6000 of the cassette will strike against the upstanding edge 3101 of the base plate 31. At this time, the locking member 48 is permitted to project fully and the second offset portion or step 4803 is placed in engagement with the corresponding rear surface portion of the front wall 6000, whereby the cassette C is positively locked. Now, the loading of the cassette has been completed.

As will be apparent from the foregoing description, by virtue of the first locking engagement between the rear surface of the lower edge of the front wall of the cassette and the first offset portion 4802 of the locking member 48, the cassette C having been inserted to this position is prevented from being withdrawn unless the lever 35 is again actuated. If otherwise, there may be arise the case where the cassette should be reinserted with the cam lever 35 being at the reset position. This menas that the micro-switch MS-1, the pressing plate 34 and so forth which project upwardly in the path of the cassette will be injured or damaged. Of course, in the case of the illustrated embodiment in which the confronting offset portion 4801 is formed in the locking member 48, such damage or injuries to the above mentioned components will be prevented because the full reinsertion of the cassette in the reset state of the cam lever 35 can be inhibited by the offset portion 4801 formed in the locking member 48.

In the case in which backlash or looseness to some degree can be tolerated, the locking member 48 may be implemented with a single offset portion.

When the recording sheet P is fed out starting from the uppermost sheet, the sheet having the loading edge reaching the first transporting rollers 17 will form a loop expanding upwardly at the bent portion 1600 of the guide plate 16 thereby to actuate the micro-switch MS-2, the output signal from which is utilized to stop the sheet feeding motor M. Thereafter, in response to the synchronizing signal produced by the detecting means such as the micro-switch for detecting the movement of the copy board 3, the first transporting rollers 17 are operated, whereby the stand-by sheet at the rollers 17 is supplied for the succeeding copying treatments.

If clogging takes place at the transporting rollers 17, the lever 53 will be rotated in the counterclockwise direction through the lowering of the holder H to lift the shaft of the upper roller 17 B. Thus, the clogging state can be easily cleared. When the cassette C is to be withdrawn for the replacement of recording sheets of a different size or for replenishment with new sheets, this can be accomplished simply by moving the cam lever 35 upwardly as in the case of the insertion of the cassette.

As will be appreciated from the foregoing description, according to the teachings of the invention, the loading of the cassette at a predetermined position as well as the withdrawal thereof can be accomplished easily and positively with a simplified structure without incurring erroneous operation.

Although the invention has been described in conjunction with the preferred embodiments illustrated in the drawings, the invention is never restricted to them but many variations and modifications thereof will readily occur to those skilled in the art without departing from the spirit and scope of the invention.

What is claimed is:

1. Apparatus for loading a cassette containing therein a plurality of sheets into a device wherein the sheets are processed, said apparatus comprising:

an actuator lever pivotally mounted on said device;

a cassette locking member which is capable of projecting into an operative position within a cassette receiving space of said device;

a first connecting means for connecting said actuator lever and said locking member to each other in such manner that said locking member is displaced from its operative position within the cassette receiving space to an inoperative position exterior of the cassette receiving space when an end of said lever remote from its pivotal mounting on said device is moved to a cassette loading position thereof;

sheet lifting means capable of projecting into an operative position within the cassette receiving space; and a second connecting means for connecting said sheet lifting means and said actuator lever to each other in such manner that said sheet lifting means is displaced from its operative position within the cassette receiving space to a position exterior of the cassette receiving space when said end of the lever is moved to said cassette loading position for loading the cassette into said device.

2. Apparatus as set forth in claim 1 wherein said locking member includes a vertical front wall surface for preventing erroneous loading of the cassette into said device, a vertical rear wall surface for properly positioning a front wall of the cassette within the cassette receiving space, and front and rear horizontal surfaces interposed between said vertical front and rear wall surfaces, wherein said front horizontal surface lies at a relatively higher level than said rear horizontal surface so as to form an offset portion of said locking member for preventing withdrawal of the cassette when said locking member projects into its operative position within the cassette receiving space.

3. Apparatus for loading a cassette containing therein a plurality of sheets into a device wherein the sheets are processed, said apparatus comprising:

an actuator lever having an end portion pivotally mounted on said device and an opposite end portion pivotally moveable between an operative and an inoperative position;

a micro-switch on said device for detecting a sheet and having an actuator of said micro-switch disposed at an upper operative position within a space in said device for receiving the cassette so that said actuator is normally engageable with a sheet contained in the cassette; and means for connecting the actuator lever and said micro-switch to each other such that said actuator of the micro-switch is displaced from said upper operative position within the cassette receiving space in which said actuator is engageable with a sheet contained within the cassette to a position of nonengagement with the sheets contained within the cassette and exterior of the cassette receiving space when said opposite end portion of the actuator lever is pivotally moved from said operative to said inoperative position.

4. Apparatus for loading a cassette containing therein a plurality of sheets into a device wherein the sheets are processed, said apparatus comprising:

an actuator lever movable between operative and inoperative positions thereof and having an end portion pivotally mounted on said device;

a micro-switch on said device for detecting the presence of a sheet in the cassette and including an actuator for said micro-switch;

a locking member for locking the cassette to said device when the cassette is loaded into a cassette receiving space of said device;

means on said device for lifting the sheets contained within the cassette;

means for detecting insertion of the cassette into said device;

a first cam surface of said actuator lever operatively coupled to said micro-switch such that when the lever is moved from its operative to its inoperative position, said micro-switch actuator is displaced from a first position within said cassette receiving space at which the actuator is engageable with a sheet contained in the cassette to a second position exterior of the cassette receiving space;

a second cam surface of said actuator lever operatively coupled to said locking member such that when the lever is moved from its operative to its inoperative position, said locking member is displaced from a position within to a position exterior of said cassette receiving space;

a third cam surface of said actuator lever operatively coupled to said sheet lifting means such that when said lever is moved from its operative to its inoperative position, said sheet lifting means is displaced from a position within to a position exterior of said cassette receiving space;

a latch surface of said actuator lever; and latching means on said device engageable with said latch surface of the actuator lever and operatively coupled to said cassette insertion detecting means for maintaining said actuator lever in its inoperative position when the same is moved thereto for disengaged release of the lever when cassette insertion into said device is detected by the insertion detecting means so as to enable the return of said actuator lever from its inoperative to its operative position in which the cassette is locked in the cassette receiving space of said device by said locking member.

* * * * *